US009549611B1

(12) United States Patent
Bocanegra

(10) Patent No.: US 9,549,611 B1
(45) Date of Patent: Jan. 24, 2017

(54) SHOWER CADDY

(71) Applicant: Sebastian Bernal Bocanegra, Greenwich, CT (US)

(72) Inventor: Sebastian Bernal Bocanegra, Greenwich, CT (US)

( * ) Notice: Subject to any disclaimer, the term of this patent is extended or adjusted under 35 U.S.C. 154(b) by 0 days.

(21) Appl. No.: 14/867,581

(22) Filed: Sep. 28, 2015

Related U.S. Application Data

(60) Provisional application No. 62/056,651, filed on Sep. 29, 2014.

(51) Int. Cl.

| | |
|---|---|
| ***A47G 29/087*** | (2006.01) |
| ***A47B 81/00*** | (2006.01) |
| ***A47K 3/28*** | (2006.01) |
| ***E03C 1/264*** | (2006.01) |
| ***A47B 96/02*** | (2006.01) |
| *D06F 57/12* | (2006.01) |

(52) U.S. Cl.
CPC ..... *A47B 81/00* (2013.01); *A47B 96/021* (2013.01); *A47K 3/281* (2013.01); *E03C 1/264* (2013.01); *D06F 57/12* (2013.01)

(58) Field of Classification Search
CPC ..... A47B 81/00; A47B 96/021; A47K 3/281; E03C 1/264; D06F 57/12
USPC ..... 211/119.009, 119.011, 119.004, 113; D6/525
See application file for complete search history.

(56) References Cited

U.S. PATENT DOCUMENTS

| | | | | | |
|---|---|---|---|---|---|
| 832,309 | A | | 10/1906 | Frey | |
| 928,236 | A | | 7/1909 | Andrews | |
| 948,954 | A | | 2/1910 | Cody | |
| 2,025,281 | A | | 12/1935 | Harvey | |
| 3,239,850 | A | * | 3/1966 | Kiss | A47K 3/004 248/447.1 |
| 3,869,183 | A | * | 3/1975 | Frank, Jr. | A47K 17/00 312/226 |
| 3,950,793 | A | * | 4/1976 | Adams | A47K 3/004 248/444.1 |
| D250,439 | S | * | 12/1978 | Holstein | D6/525 |
| D272,969 | S | | 3/1984 | Sussman | |
| D286,599 | S | * | 11/1986 | Sussman | D6/525 |
| D293,183 | S | * | 12/1987 | Aaron | D6/525 |
| D309,225 | S | | 7/1990 | Scarbro | |
| D315,840 | S | * | 4/1991 | Emery | D6/525 |
| 5,003,642 | A | | 4/1991 | Robb | |
| 5,180,067 | A | * | 1/1993 | Conaway | A47K 5/04 211/119 |
| D335,232 | S | * | 5/1993 | Whitlock | D6/525 |
| D351,461 | S | * | 10/1994 | Wannamaker | D23/304 |
| D351,750 | S | * | 10/1994 | Sweeney | D6/525 |
| D359,186 | S | * | 6/1995 | Wang | D6/525 |

(Continued)

*Primary Examiner* — Jonathan Liu
*Assistant Examiner* — Devin Barnett
(74) *Attorney, Agent, or Firm* — Seth Natter; Natter & Natter

(57) ABSTRACT

A shower caddy includes horizontal shelves and a vertically sloped panel having a smooth surface. A bottom edge of the panel is positioned above and in registration with a hair screen carried within a lowermost shelf. Hair from one's head and body caught on one's hands and fingers during washing are transferred to the panel by touching the panel or land directly on the panel. Water overspray during showering or direct splashing causes the hair to slide down the panel and become trapped in the screen, which is easily removed from the shelf for disposal of the collected hair.

15 Claims, 6 Drawing Sheets

(56) References Cited

U.S. PATENT DOCUMENTS

D368,128 S * 3/1996 McCarthy ..... D23/213
D387,595 S * 12/1997 Whang ..... D6/525
D392,135 S * 3/1998 Pagan-Demirtas ..... D6/525
D396,585 S * 8/1998 Hofman ..... D6/525
D417,990 S * 12/1999 Yemini ..... D6/525
6,058,522 A * 5/2000 Thakrar ..... A47K 3/004 4/559
D428,744 S * 8/2000 Patel ..... D6/525
D428,745 S * 8/2000 Patel ..... D6/525
D429,934 S * 8/2000 Hofman ..... D6/525
6,149,277 A 11/2000 Broussard
D443,162 S * 6/2001 Winter ..... D6/525
D447,900 S * 9/2001 Wright ..... D6/525
D448,225 S * 9/2001 Wright ..... D6/525
6,520,351 B1 * 2/2003 Zadro ..... A47K 3/281 211/106
D475,560 S * 6/2003 Suero, Jr. ..... D6/525
6,932,223 B1 * 8/2005 Lee ..... B25H 3/04 206/349
D550,819 S 9/2007 Seehoff
D562,608 S * 2/2008 Kramer ..... D6/525
D564,271 S * 3/2008 Snider ..... D6/525
D566,440 S * 4/2008 Dretzka ..... D6/525
D566,441 S * 4/2008 Dretzka ..... D6/525
D568,656 S * 5/2008 Kramer ..... D6/525
D568,658 S * 5/2008 Yang ..... D6/525
7,367,065 B2 5/2008 Gregg
D572,062 S 7/2008 Snider
D603,198 S * 11/2009 Guindi ..... D6/525
D615,333 S * 5/2010 Snell ..... D6/525
D616,235 S * 5/2010 Guindi ..... D6/525
D622,990 S * 9/2010 Yang ..... D6/525
D670,520 S * 11/2012 Gilbert ..... D6/525
D676,696 S * 2/2013 Primeau ..... D6/525
8,505,125 B1 8/2013 Chia
D698,184 S * 1/2014 Tawil ..... D6/525
D718,554 S * 12/2014 Snider ..... D6/525
D730,493 S 5/2015 Sehl
9,022,237 B2 * 5/2015 Hall ..... A47J 47/16 211/162
9,433,326 B2 * 9/2016 Dye ..... A47K 5/08
2005/0223481 A1 10/2005 Giacomi
2008/0047913 A1 * 2/2008 Naden ..... A47K 3/281 211/119.009
2008/0053935 A1 * 3/2008 Newbouild ..... A47B 57/08 211/90.02
2010/0282696 A1 * 11/2010 Shang ..... A47B 47/0033 211/34
2012/0091088 A1 * 4/2012 Didehvar ..... A47B 45/00 211/113
2012/0167294 A1 7/2012 Ben-Menachem
2013/0220957 A1 * 8/2013 Malik ..... A47B 57/04 211/119.004
2013/0313212 A1 * 11/2013 Lindo ..... A47K 3/281 211/119.011
2014/0116973 A1 * 5/2014 Buckley ..... A47F 5/00 211/134
2014/0217690 A1 * 8/2014 Schumaker ..... B62B 3/005 280/47.35
2014/0224754 A1 * 8/2014 Baines ..... A47K 3/281 211/119.009
2014/0284293 A1 * 9/2014 Greco ..... A47K 3/281 211/85.12
2015/0257533 A1 * 9/2015 Yang ..... B65D 21/086 220/4.01
2015/0342419 A1 * 12/2015 Yatscoff ..... F16B 45/04 211/119.011

* cited by examiner

SHOWER CADDY

RELATED APPLICATIONS

This application claims the benefit of priority of U.S. Provisional Patent Application No. 62/056,651 filed Sep. 29, 2014 and entitled "Shower Caddy," the contents of which are incorporated herein by reference in its entirety.

BACKGROUND OF THE INVENTION

1. Field of the Invention

This invention relates generally to shower caddies and more specifically to a combined shower caddy and apparatus for the capture of hair prior to reaching a drain opening at the shower floor or tub bottom.

2. Antecedents of the Invention

Showers used in homes, hotels and other such structures usually are of two main types. One type includes a bathtub, with the shower arm protruding from a wall forming part of the structure which partially encloses the shower. Access is typically provided through an opening adjacent to the longer side of the tub. Usually, the opening is closeable by a shower curtain or by one or more sliding or swinging doors. A second type of shower consists of an enclosure or stall which has a shower arm and head protruding from a wall or ceiling, and which is also closeable by a curtain, or by a sliding or swinging door.

The clogging of shower drains with hair has been a constant problem. Many approaches have attempted to alleviate this problem, primarily directed to placing a hair catching device at or within a shower or tub drain. Examples of hair catching devices placed at the drain are shown in U.S. Pat. Nos. D550,819 and D730,493 and Publication No. 2005/0223481, while examples of hair catching devices placed within the drain are illustrated in U.S. Pat. Nos. 5,003,642 and 8,505,125 B1. Unfortunately, the devices intended for placement at the drains, e.g. those exemplified by U.S. Pat. Nos. D550,819 and D730,493 were subject to inadvertent dislodgement and hair often bypassed the device and went directly down the drain while an individual showered.

Devices intended for placement within the drain, e.g., U.S. Pat. Nos. 5,003,642 and 8,505,125 B1 required removal from the drain for cleaning and generally were not cleaned after each shower. Thus accumulated hair was not removed until water flow became restricted or clogged. The removal of tangled hair became a messy and time consuming task. Additionally, the removal of hair caught in both types of devices required one to bend down and lift up the hair catching device, which was a difficult task for handicapped individuals.

It is now common for the shower and tub area of a bathroom to be filled with a large number of products and accessories. These products include shampoos, hair conditioners, soaps, scrubs, lotions and oils. This has created a greater need for storage in what is most often a limited space. The many containers for such products can create clutter, be unsightly, and possibly cause a safety hazard.

Shower caddies have been used to organize the products found in a shower. Shower caddies most often hang on the shower arm pipe that comes out from the wall which holds the shower head. Most shower caddies currently available are constructed to be attached to the shower arm, by hanging the caddy on the arm. In some instances, such as that illustrated in U.S. Pat. No. D309,225, shower caddies have been employed to support a shaving mirror.

SUMMARY OF THE INVENTION

An exemplary embodiment of the present invention comprises a shower caddy configured to be suspended from a shower arm. The caddy includes a plurality of horizontal shelves and a vertically sloped panel having a smooth surface. A bottom edge of the panel is positioned above and in registration with a hair screen carried within a lower shelf. Hair from one's head and body caught on one's hands and fingers during washing are transferred to the panel by touching the panel or land directly on the panel. Water overspray during showering or direct splashing causes the hair to slide down the panel and become trapped in the screen, which is easily removed from the shelf for disposal of the collected hair.

From the foregoing compendium, it will be appreciated that an aspect of the present invention is to provide a shower caddy having a hair collection screen of the general character described which is not subject to the disadvantages of the aforementioned antecedents of the invention.

A feature of the present invention is to provide a shower caddy of the general character described which catches hair in a removable screen positioned at a convenient height.

A consideration of the present invention is to provide a shower caddy having a hair collection screen of the general character described which is well suited for economical mass production fabrication.

Another feature of the present invention is to provide a shower caddy having a hair collection screen of the general character described which is convenient to use and promotes removal of trapped hair after each shower.

An additional aspect of the present invention is to provide a shower caddy having a hair collection screen of the general character described which does not require bending down to remove collected hair.

A further consideration of the present invention is to provide a shower caddy having a hair collection screen of the general character described which provides for convenient storage of shampoos and other bathing accessories.

A still further feature of the present invention is to provide a shower caddy having a hair collection screen of the general character described which includes a sloped panel having a bottom edge positioned above the screen.

Yet another aspect of the present invention is to provide a shower caddy having a hair collection screen of the general character described which includes a sloped panel having a mirrored surface.

Another feature of the present invention is to provide a hair collection screen for use in a shower which screen is positioned at a convenient height so as not to require bending down for removal of collected hair.

Another consideration of the present invention is to provide a hair collection screen for use in a shower which screen is positioned beneath a sloped panel.

Other aspects, features and considerations of the present invention in part will be obvious and in part will be pointed out hereinafter.

With these ends in view, the invention finds embodiment in various combinations of elements, arrangements of parts and series of steps by which the above-mentioned aspects, features and considerations and certain other aspects, features and considerations are attained, or with reference to the accompanying drawings and the scope of which will be more particularly pointed out and indicated in the appended claims.

BRIEF DESCRIPTION OF THE DRAWINGS

In the accompanying drawings, in which are shown an exemplary embodiment of the present invention.

DETAILED DESCRIPTION OF THE PREFERRED EMBODIMENT

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements.

Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein.

Moreover, applicant does not intend for any term in the specification or claims to be ascribed an uncommon or special meaning unless explicitly set forth as such. Further, the present invention encompasses present and future known equivalents to the known components referred to herein by way of illustration.

Figure 1:
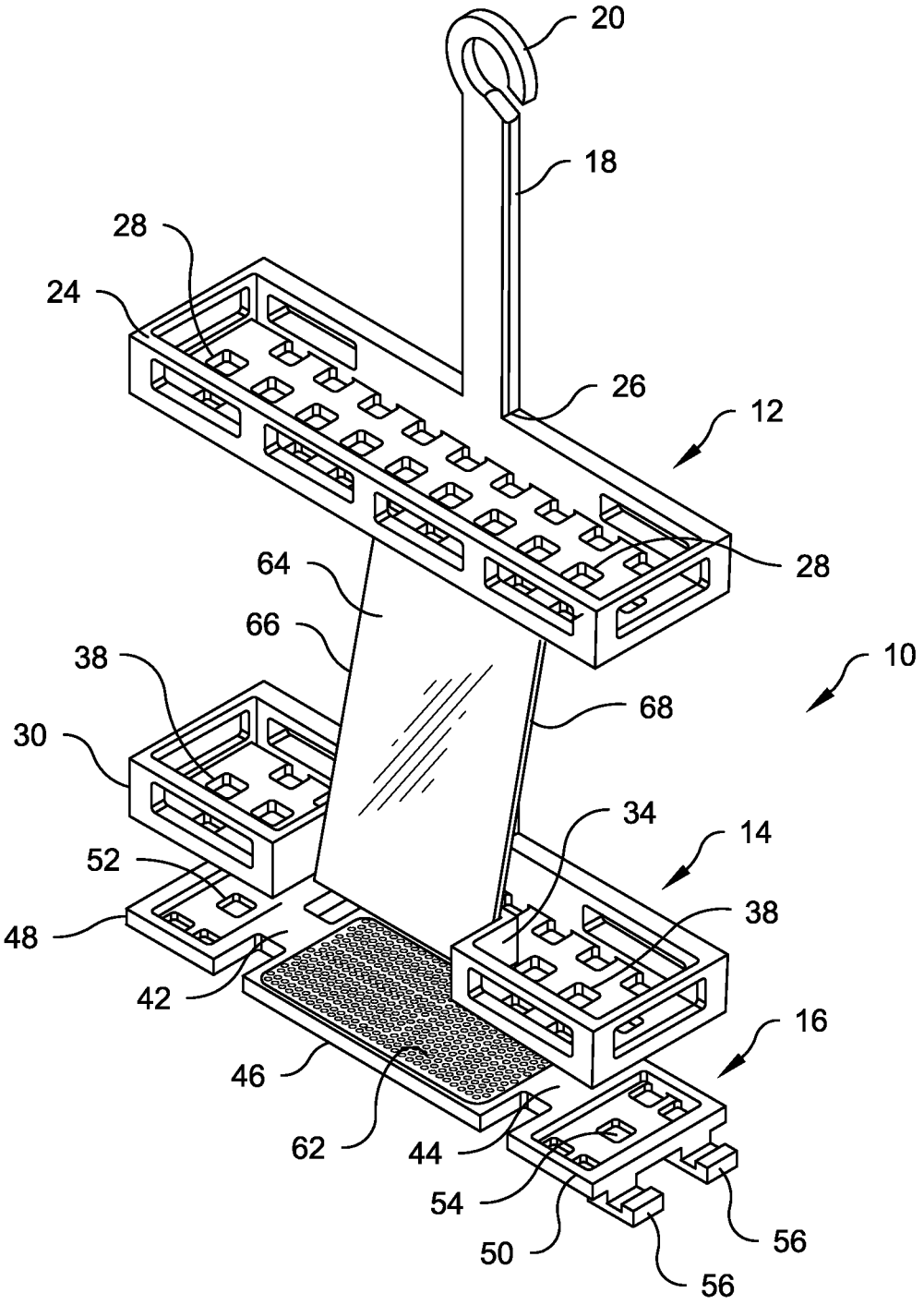
FIG. 1 is a front isometric view of a shower caddy having a hair collection screen in accordance with the present invention and showing a plurality of horizontal shelves and a sloped panel positioned above the screen.
Figure 2:
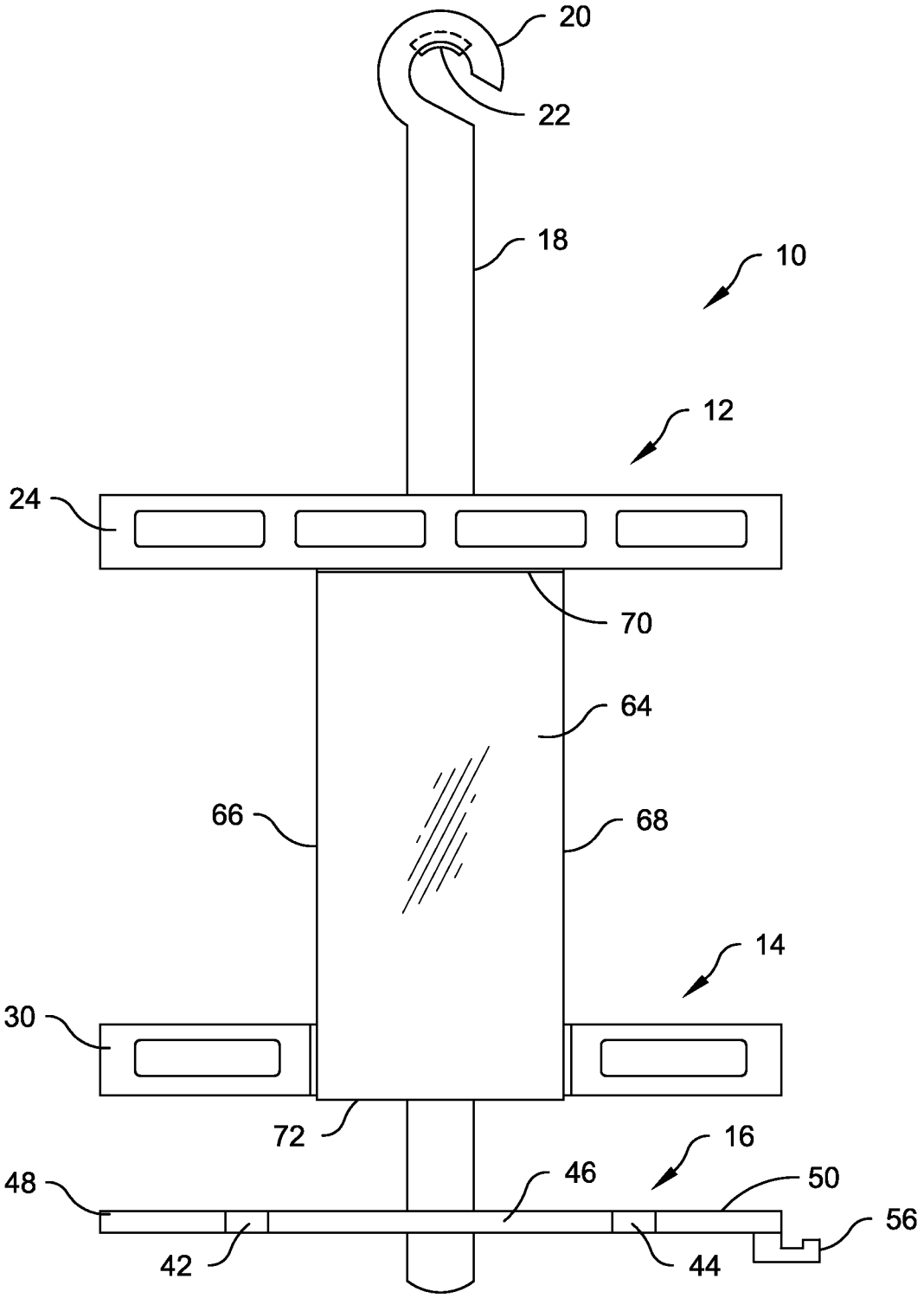
FIG. 2. is a front elevational view of the shower caddy.

Referring now in detail to the drawings, the reference numeral 10 denoted generally a shower caddy constructed in accordance with and embodying the invention. The shower caddy 10 includes a plurality of generally horizontal shelves 12, 14 and 16, which are illustrated as having a substantially rectangular overall outline, however alternate shapes such as oval, circular, etc., may readily be employed. The shelves 12, 14 and 16 are mounted to a vertical support column or pillar 18 having a hook 20 at an upper end for engagement over a shower arm 21. A rubber inset 22, illustrated in FIG. 2, may be seated in the crotch of the hook 20 for stability.

The upper shelf 12 includes a peripheral rail 24 which projects upwardly from the front, side and rear edges of the shelf 12. The portion of the rail 24 at the rear edge can include a notch 26 to accommodate the column 18. The upper shelf 12 also includes a plurality of drain apertures 28 and is suited for convenient storage of consumable showering items, such as, shampoo, hair conditioner, shower gel, etc., packaged in and dispensed from bottles or tubes.

Figure 3:
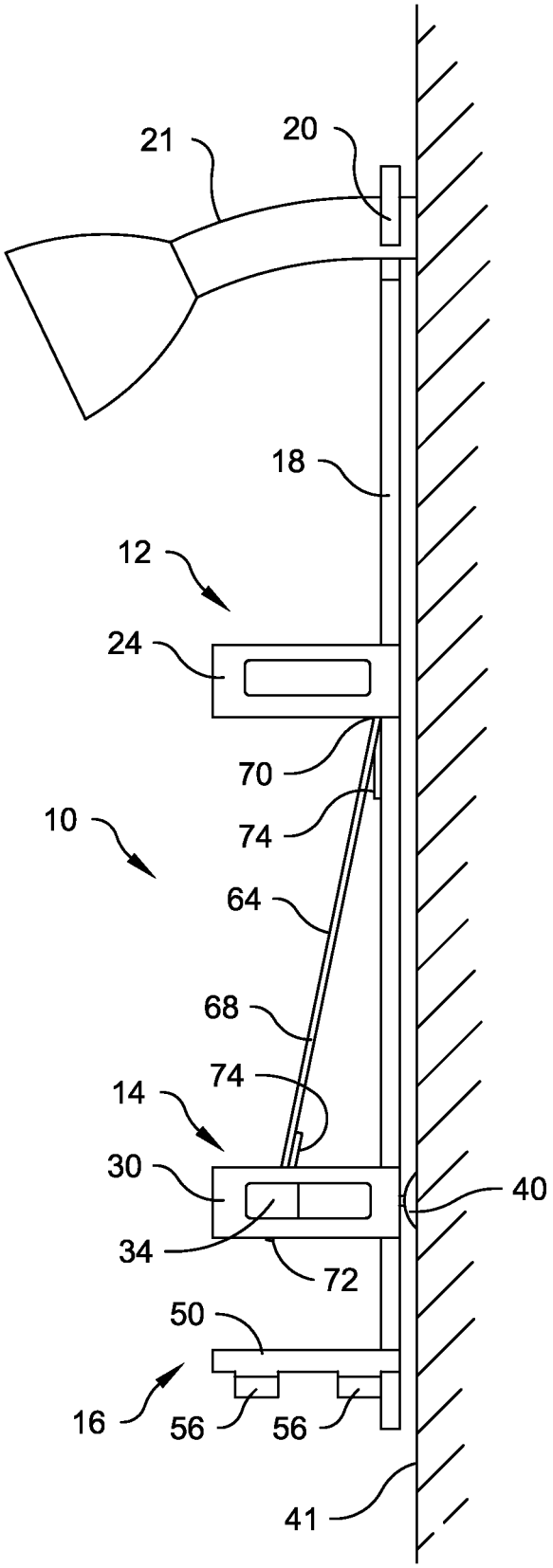
FIG. 3 is a right side elevational view of the shower caddy.
Figure 4:
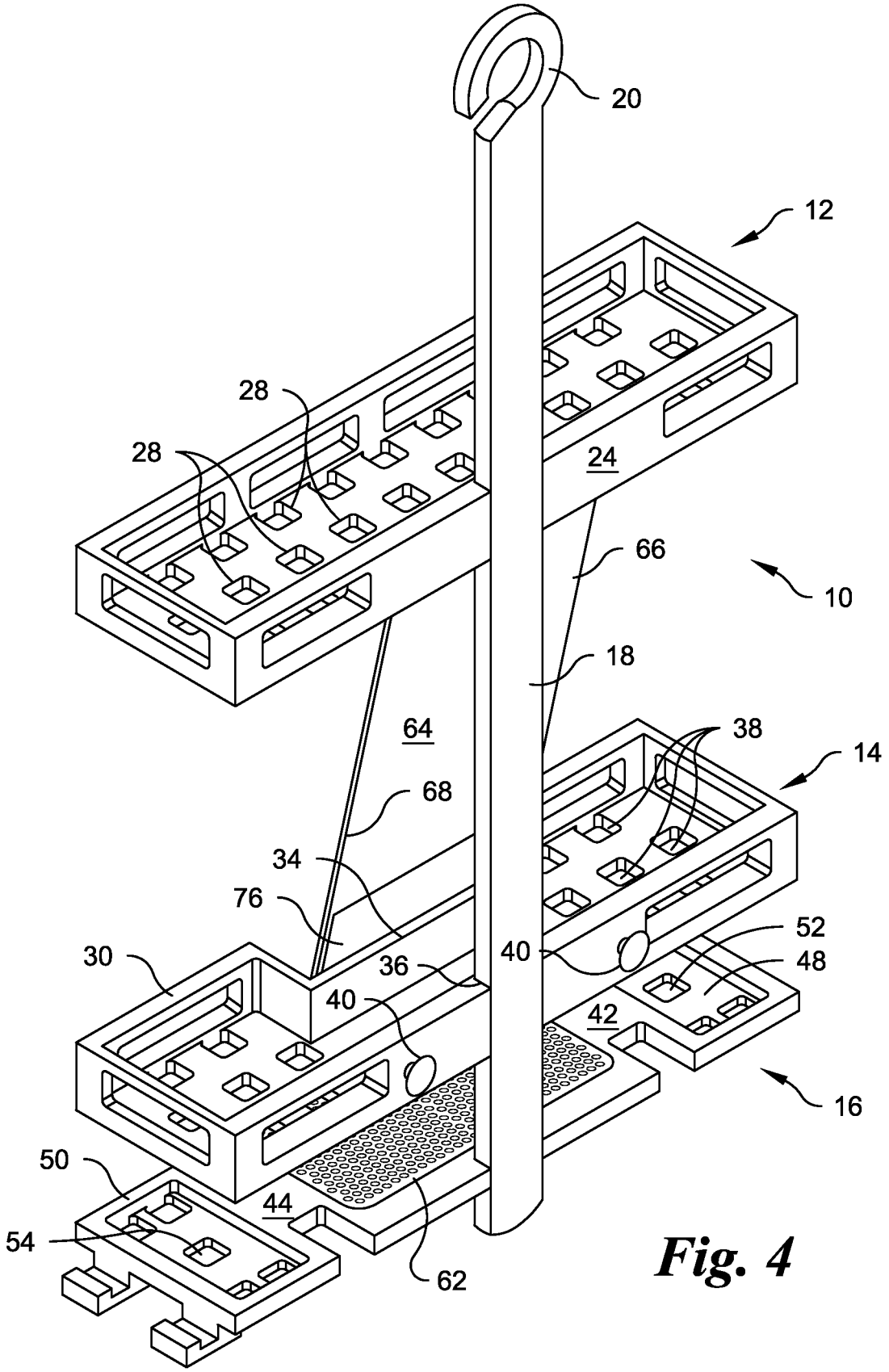
FIG. 4 is rear isometric view thereof.
Figure 5:
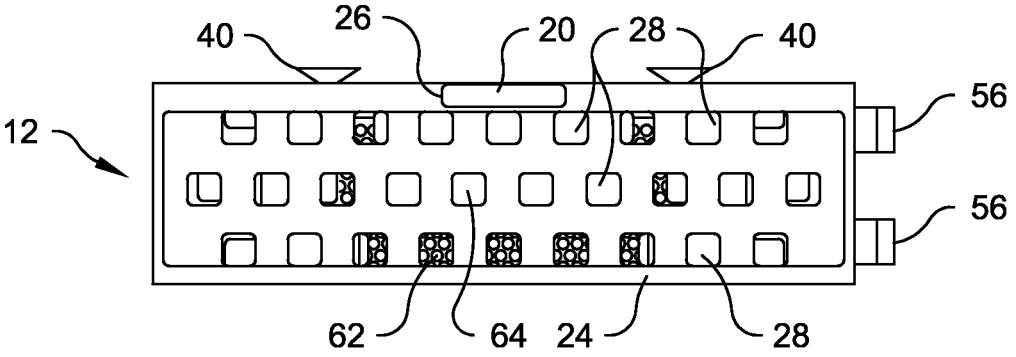
FIG. 5 is a top plan view.
Figure 6:
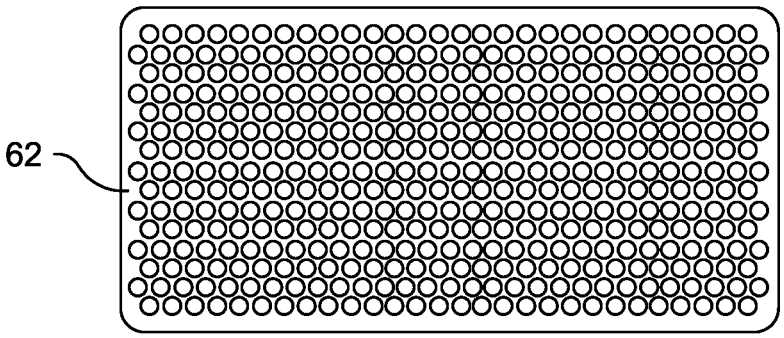
FIG. 6 is an enlarged scale plan view of the hair catching screen which is seated in a recessed lip of the lowermost shelf.
Figure 7:
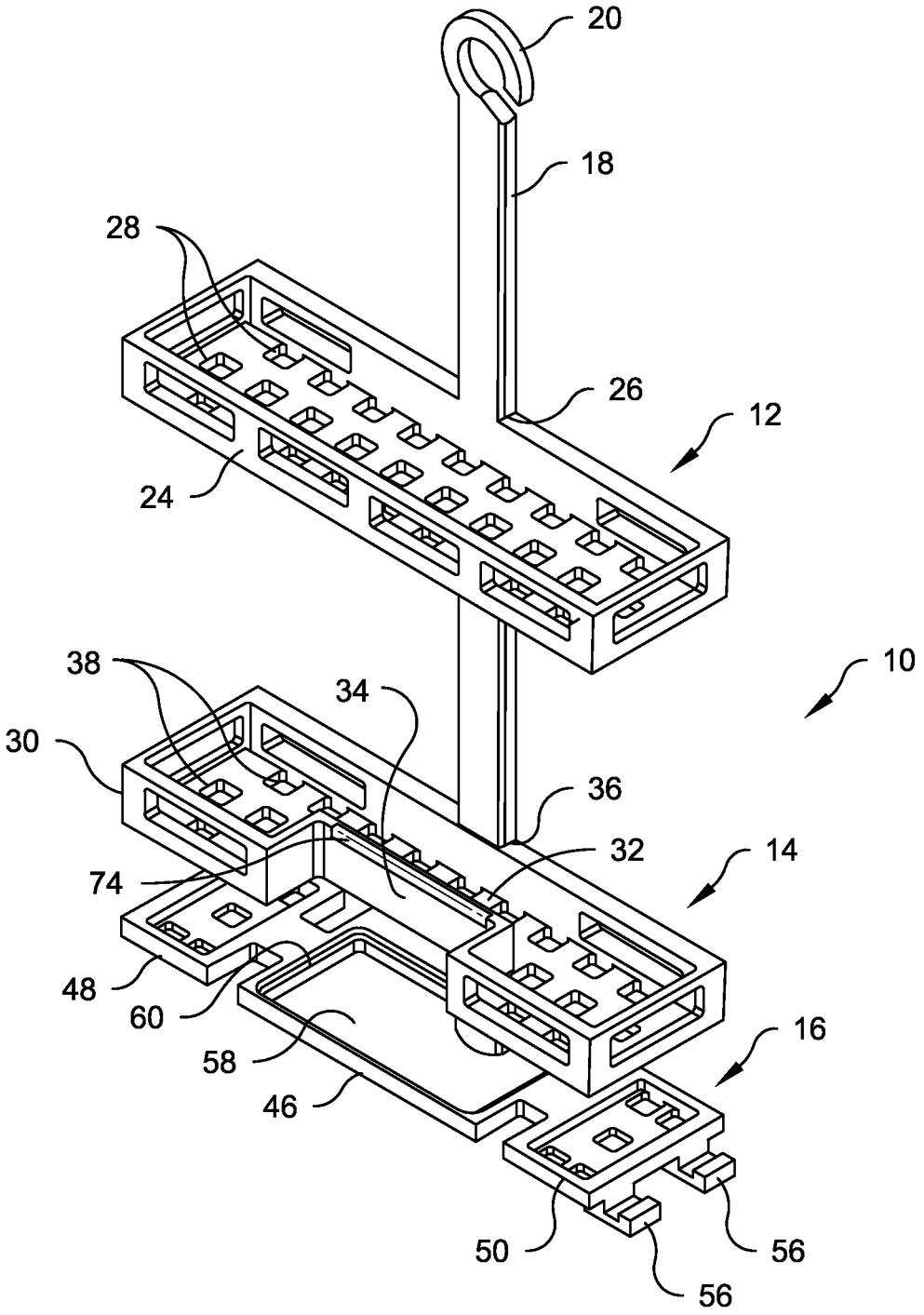
FIG. 7 is a front isometric view of the shower caddy, with the sloped panel removed for clarity and with hair collection screen removed to better illustrate the recessed lip.

The middle shelf 14 includes a peripheral rail 30 which projects upwardly from the front, side and rear edges of the shelf 14. As best shown in FIG. 7, the middle shelf 14 is of reduced or narrowed width at a central zone 32 and the front edge is correspondingly shaped as is a corresponding portion 34 of the rail 30. The portion of the rail 30 at the rear edge of the shelf 14 can include a notch 36 to accommodate the column 18. The shelf 14 also includes a plurality of drain apertures 38 and is also suited for convenient storage of consumable showering items. With reference to FIGS. 3 and 4, it will be seen that a plurality of suction cups 40 are mounted on the portion of the rail 30 at the rear edge of the shelf 14 to stabilize the shower caddy 10 by being adhered to a wall 41 of the shower enclosure or the bathroom wall above a tub.

It should also be noted that the shower caddy 10 may be directly secured to the wall of the shower enclosure or the bathroom wall above a tub by suction cups or other common fastener arrangements, without being suspended from a shower arm.

The lowermost shelf 16 is generally planar and includes a pair of neck zones 42, 44 of reduced width and which separate the shelf 16 into a central support platform 46 and a pair of lateral support platforms 48, 50. The platforms 48 and 50 include drain apertures 52, 54 respectively, and recessed upper surfaces for seating bars of soap and the like. Projecting from the platform 50 are a pair of hooks 56 for suspending brushes, washcloths and other accessories.

With attention now directed to the central support platform 46, it should be noted that there is provided a generally rectangular central aperture 58 having a peripheral lip 60 which is recessed from the upper surface of the shelf 16, as best illustrated in FIG. 7. Removably seated in the recessed lip is a hair collection screen 62, illustrated in FIGS. 1, 4, 5 and 6.

A rectangular planar panel 64 having a pair of parallel side edges 66, 68 and a pair of parallel top and bottom edges 70, 72, respectively, is secured to the shower caddy 10 in a vertically sloped position and functions as a hair collection and discharge surface. The panel may be transparent, translucent, opaque, or may have a mirrored surface for use when shaving. As best seen in FIG. 3, the top edge 70 of the panel 64 is mounted or secured to the underside of the upper shelf 12 or the support column 18 or both at the juncture of the upper shelf 12 and the support column 18.

The panel 64 seats against and may be mounted to the upper edge of the rail portion 34 of the middle shelf rail 30. The bottom edge 72 of the panel 64 extends beneath the middle shelf 14 and is in registration with and positioned directly above the hair collection screen 62. Optionally, the angle of inclination of the panel 64 may be adjusted, as by providing a strip 74 of hook and loop fastener along the support column 18, a further strip along the upper edge of the rail portion 34 and a mating strip along the rear face of the panel 64.

In use, hair from one's head and body caught on one's hands and fingers during showering are transferred to the panel 64 merely by touching the panel or may land directly on the panel. Water overspray during showering or direct splashing causes the hair to slide down the panel, discharge from the bottom edge 72 and become trapped in the hair collection screen 64 before reaching the drain. The hair collection screen 64 is easily removed from the central platform 46, which is at a convenient height, for disposal of the collected hair.

Thus it will be seen that there is provided a shower caddy which achieves the various aspects, features and considerations of the present invention and which is well suited to meet the conditions of practical usage.

In the figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the invention must comprise more than one of that element or step, nor is it intended by illustrating a single element that the invention is limited to embodiments having only a single one of that respective element. Those skilled in the art will recognize that the numbers of a particular element shown in a drawing can, in at least some instances, be selected to accommodate the particular user needs.

The particular combinations of elements and features in the above-detailed embodiment are exemplary only; the interchanging and substitution of these teachings with other teachings in this application are also expressly contemplated. As those skilled in the art will recognize, variations, modifications, and other implementations of what is described herein can occur to those of ordinary skill in the art without departing from the spirit and the scope of the invention as claimed.

Further, in describing the invention and in illustrating embodiments of the invention in the figures, specific terminology, numbers, dimensions, materials, etc., are used for the sake of clarity. However the invention is not limited to the specific terms, numbers, dimensions, materials, etc. so selected, and each specific term, number, dimension, material, etc., at least includes all technical and functional equivalents that operate in a similar manner to accomplish a similar purpose. Use of a given word, phrase, number, dimension, material, language terminology, product brand, etc. is intended to include all grammatical, literal, scientific, technical, and functional equivalents. The terminology used herein is for the purpose of description and not limitation.

Having described the preferred embodiment of the invention, it will now become apparent to one of ordinary skill in the art that other embodiments incorporating the concept may be used. Moreover, those of ordinary skill in the art will appreciate that the embodiment of the invention described herein can be modified to accommodate and/or comply with changes and improvements in the applicable technology and standards referred to herein.

For example, the technology can be implemented in many other, different, forms, and in many different environments, and the technology disclosed herein can be used in combination with other technologies. Variations, modifications, and other implementations of what is described herein can occur to those of ordinary skill in the art without departing from the spirit and the scope of the invention as claimed. It is felt therefore that these embodiments should not be limited to the disclosed embodiment but rather should be limited only by the spirit and scope of the appended claims.

Having thus described the invention, there is claimed as new and desired to be secured by Letters Patent:

1. A hair collection apparatus for use in a shower and configured for suspension from a shower arm, the apparatus comprising a hair collection screen having a periphery, the screen being configured to block the passage of hairs and permit the passage of shower water there through, the apparatus further comprising a smooth vertically sloped surface fixed above the screen, the sloped surface having a top edge and a bottom edge, the bottom edge being positioned above and in registration with the screen, whereby hair transferred to the sloped surface during showering will descend from the bottom edge and be collected in the screen while shower water passes through the screen, wherein the sloped surface is removably attached to the hair collection apparatus at locations near the top edge and bottom edge of the sloped surface; the apparatus further including a first substantially horizontal shelf having an aperture, the shelf including a recessed peripheral lip surrounding the aperture, the peripheral lip supporting the hair collection screen, the hair collection screen being removably seated in the recessed peripheral lip in order to suspend the screen above a floor of the shower.

2. A hair collection apparatus for use in a shower in accordance with claim 1 wherein the smooth vertically sloped surface is planar.

3. A hair collection apparatus for use in a shower in accordance with claim 1 wherein the hair collection screen is planar.

4. A hair collection apparatus for use in a shower in accordance with claim 1, the apparatus further including a second substantially horizontal shelf and a third substantially horizontal shelf, the second shelf being positioned above the first shelf and the third shelf being positioned above the second shelf, the smooth vertically sloped surface being positioned beneath the third shelf and the bottom edge being positioned beneath the second shelf and above the first shelf.

5. A hair collection apparatus for use in a shower in accordance with claim 4, further including a support column, the first, second and third substantially horizontal shelves being joined to the support column.

6. A hair collection apparatus for use in a shower in accordance with claim 5, wherein the support column is configured with a hook at its upper end for suspension from a shower arm.

7. In a shower caddy configured for suspension from a shower arm comprising a plurality of generally horizontal shelves, a first shelf being configured for storage of consumable showering items, the improvement comprising a removable hair collection screen configured to block the passage of hair, the hair collection screen having a periphery, a second substantially horizontal shelf having an aperture, a recessed peripheral lip surrounding the aperture, the peripheral lip supporting the hair collection screen completely around the periphery of said screen, the hair collection screen being removably seated in the recessed peripheral lip in order to suspend the screen above a floor of a shower; the improvement further comprising a smooth generally planar vertically sloped panel positioned above the hair collection screen, the panel having a top edge and a bottom edge, the bottom edge being positioned below the first shelf, the bottom edge being positioned in registration with the hair collection screen, wherein the sloped surface is removably attached to the shower caddy at locations near the top edge and bottom edge of the sloped surface, whereby hair transferred to the panel during showering will slide down the panel into the hair collection screen.

8. An improved shower caddy in accordance with claim 7 wherein the second shelf is a lowermost shelf and the first shelf is a middle shelf, the shower caddy further including an upper shelf configured for storage of consumable showering items.

9. An improved shower caddy in accordance with claim 8 wherein the smooth vertically sloped panel is positioned beneath the upper shelf.

10. An improved shower caddy in accordance with claim 9 wherein a portion of the vertically sloped panel overlies a portion of the middle shelf and a further portion of the vertically sloped panel abuts the middle shelf.

11. An improved shower caddy in accordance with claim 10 wherein the middle shelf includes a peripheral rail and a portion of the vertically sloped panel abuts the peripheral rail.

12. An improved shower caddy in accordance with claim 7 further including a support column, the first shelf and the second shelf being joined to the support column.

13. An improved shower caddy in accordance with claim 7 wherein the panel is adjustably fixed to the first shelf.

14. A method of reducing the accumulation of hair at a shower or bathtub drain, the method comprising the steps of:

a) providing an improved shower caddy in accordance with claim 7, b) transferring hair from hands and fingers to the panel by touching the panel during showering, c) causing the hair to slide down the panel and off the bottom edge of the panel by applying water to the panel, d) collecting the hair in the screen, e) removing the screen from the further shelf, and f) emptying the collected hair from the screen.

15. A method of reducing the accumulation of hair at a shower or bathtub drain, the method comprising the steps of:

a) providing a hair collection apparatus in accordance with claim 1, b) transferring hair from hands and fingers to the smooth vertically sloped surface by touching the smooth vertically sloped surface during showering, c) causing the hair to slide down the smooth vertically sloped surface and off the bottom edge by applying water to the smooth vertically sloped surface, d) collecting the hair in the screen, and e) emptying the collected hair from the screen.

* * * * *